US010797386B2

(12) United States Patent
Shimada

(10) Patent No.: US 10,797,386 B2
(45) Date of Patent: Oct. 6, 2020

(54) ELECTRONIC DEVICE INCLUDING ANTENNA MODULE

(71) Applicant: PANASONIC INTELLECTUAL PROPERTY MANAGEMENT CO., LTD., Osaka (JP)

(72) Inventor: Hajime Shimada, Tokyo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 25 days.

(21) Appl. No.: 16/353,722

(22) Filed: Mar. 14, 2019

(65) Prior Publication Data

US 2019/0288385 A1 Sep. 19, 2019

(30) Foreign Application Priority Data

Mar. 19, 2018 (JP) ..... 2018-051363

(51) Int. Cl.
*H01Q 1/38* (2006.01)
*H01Q 1/48* (2006.01)
*H01Q 1/42* (2006.01)

(52) U.S. Cl.
CPC ..... *H01Q 1/48* (2013.01); *H01Q 1/38* (2013.01); *H01Q 1/42* (2013.01)

(58) Field of Classification Search
CPC .. H01Q 1/36; H01Q 1/38; H01Q 1/42; H01Q 1/48; H01Q 1/243; H01Q 1/2291; H05K 1/05; H05K 1/09; H05K 1/14; H05K 1/16; H05K 3/0064
See application file for complete search history.

(56) References Cited

U.S. PATENT DOCUMENTS

| | | | | |
|---|---|---|---|---|
| 10,107,952 | B2 * | 10/2018 | Lim | G02B 6/0045 |
| 10,461,398 | B2 * | 10/2019 | Tunnell | H01Q 1/2291 |
| 10,476,133 | B2 * | 11/2019 | Okamoto | H05K 1/0393 |
| 2019/0157768 | A1 * | 5/2019 | Liu | H01Q 9/0421 |

FOREIGN PATENT DOCUMENTS

| | | |
|---|---|---|
| JP | 2015-008375 | 1/2015 |

* cited by examiner

*Primary Examiner* — Haissa Philogene
(74) *Attorney, Agent, or Firm* — Greenblum & Bernstein, P.L.C.

(57) ABSTRACT

In a metal housing, an opening is provided in a first surface. A second substrate is disposed inside the metal housing and has a communication circuit and a ground unit provided thereon. An antenna module includes an antenna pattern provided on an upper step surface of a base and a ground pattern provided on a lower step surface. In the antenna module, the antenna pattern is exposed through the opening, and the ground pattern opposes a back side of the first surface. The ground pattern is electrically connected to the back side of the first surface and electrically connected to the ground unit via a coaxial cable. The ground unit is electrically connected to the metal housing.

6 Claims, 4 Drawing Sheets

20

ELECTRONIC DEVICE INCLUDING ANTENNA MODULE

CROSS-REFERENCE TO RELATED APPLICATION

This application is based upon and claims the benefit of priority from the prior Japanese Patent Application No. 2018-051363, filed on Mar. 19, 2018, the entire contents of which are incorporated herein by reference.

BACKGROUND

1. Field

The present disclosure relates to electronic devices and relates, in particular, to an electronic device including an antenna nodule.

2. Description or the Related Art

Increasingly, on-board electronic devices, such as a car navigation device, wirelessly communicate with occupant's mobile devices, such as a mobile phone, a smartphone, or a tablet terminal. In such a case, communication sensitivity between an electronic device and a mobile device needs to be enhanced. To this end, an antenna is disposed on a hack side of a screen of the electronic device, and the antenna is so oriented as to be inclined in an up-down direction relative to the direction normal to the screen (see, for example, patent document 1).

(Patent Document 1) JP2015-8375

In some cases, an antenna needs to be disposed on a surface other than where the screen is disposed. In such a case, if an electronic device includes a metal housing, the antenna is affected by the metal housing. It is desired that the influence of the metal housing on the antenna be reduced.

SUMMARY

In view of such a situation, the present disclosure is directed to providing a technique for reducing the influence of a metal housing.

To address the above issue, an electronic device according to an aspect of the present disclosure includes a metal housing including one surface with an opening provided therein; a substrate disposed inside the metal housing, the substrate having a communication circuit and a ground unit provided thereon; and an antenna module including a base having an upper step surface and a lower step surface arrayed in a non-over lapping manner, an antenna pattern provided on the upper step surface, and a ground pattern provided on the lower step sur face. In the antenna module, the antenna pattern on the upper step surface is exposed through the opening in the one surface of the metal housing, and the ground pattern on the lower step surface opposes a back side of the one surface of the metal housing. The ground pattern on the lower step surface is electrically connected to the back side of the one surface of the metal housing and electrically connected to the ground unit on the substrate via a cable. The ground unit on the substrate is electrically connected to the metal housing.

DETAILED DESCRIPTION

Figure 1:
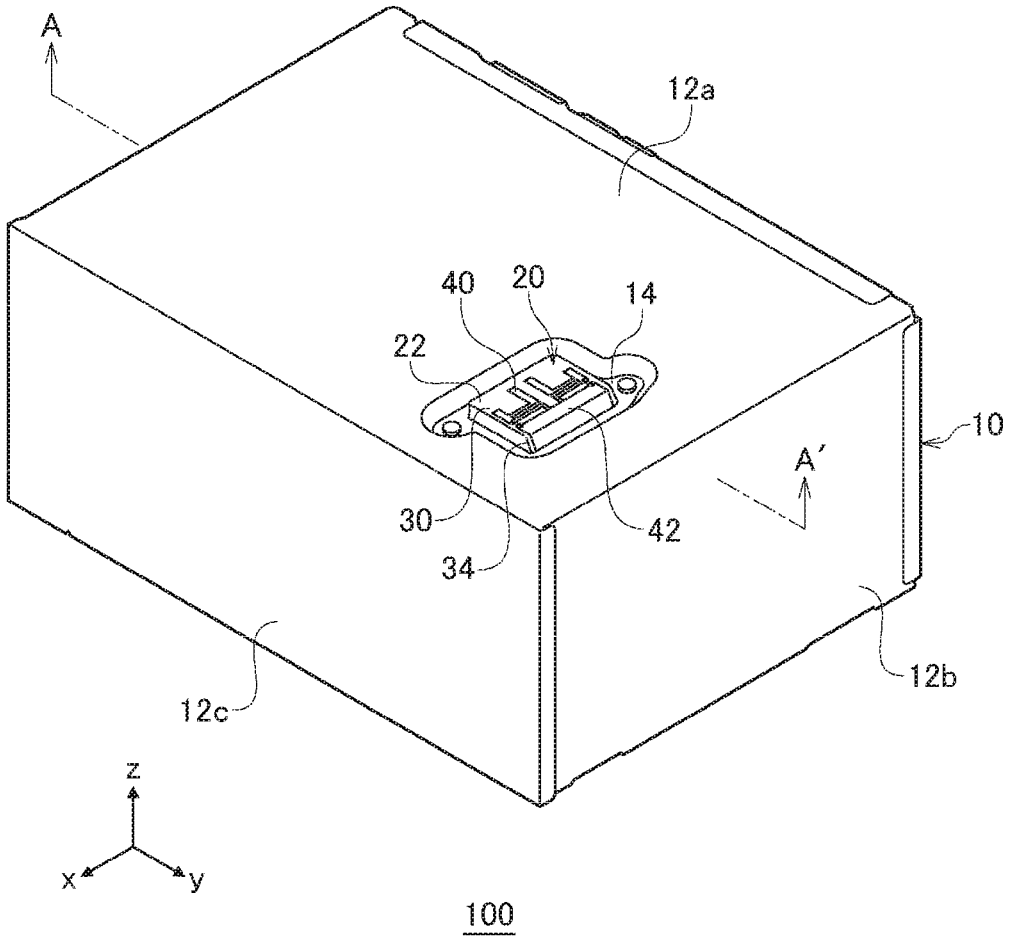
FIG. 1 is a perspective view illustrating a structure of an electronic device according to an embodiment.

The invention will now be described by reference to the preferred embodiments. This does not intend to limit the scope of the present invention, but to exemplify the invention.

Prior to describing the present disclosure in concrete terms, an overview will be given. The present embodiment relates to an electronic device that can be mounted in a vehicle or the like. The electronic device is covered by a metal housing and includes an antenna for wireless communication. A wireless local area network (LAN) or Bluetooth (registered trademark), for example, is used in wireless communication. To reduce the influence of the metal housing on such an antenna, the antenna is affixed, for example, on the metal housing.

However, constraints imposed when the electronic device is attached to a vehicle restrict the size of the metal housing. If the antenna is to be affixed on the metal housing, the size of the metal housing needs to be reduced. Meanwhile, for increased performance of the electronic device, reducing the size of the metal housing is not desirable. In addition, if the antenna is affixed on the metal housing, desired antenna characteristics may not be ensured due to the influence of metal surrounding the antenna.

To reduce the influence of a metal housing on an antenna, the antenna is mounted on a separate display device having fewer metal components. When a 5-GHz wireless LAN is to be supported, there is defined a radio wave authentication regulation stating that the wireless LAN needs to shift to a different channel upon detecting a weather radar in outdoor use. If an antenna is mounted on a display device disposed away from the electronic device, the radio wave authentication regulation may fail to be met due to an insertion loss in a cable connecting the electronic device and the display device.

An electronic device according to the present, embodiment uses an antenna module having an antenna pattern provided on an upper step surface of a step shape and a ground pattern provided on a lower step surface. An opening is provided in a portion of one surface, or a top surface, of a metal housing, and the antenna module is attached to the metal housing such that the antenna pattern is exposed through the opening. A back side of the one surface of the metal housing opposes the ground pattern. A substrate is disposed inside the metal housing, and a communication circuit and a ground unit are provided on the substrate. In this structure, the back side of the one surface of the metal housing and the ground pattern are electrically connected to each other, the ground pattern and the ground unit are electrically connected to each other via a coaxial cable, and the ground unit and the metal housing are electrically connected to each other. In this manner, the antenna pattern is exposed, and a ground level is shared by the antenna module, the metal housing, and the substrate. Thus, the influence of the metal housing is reduced.

In the following description, the term "parallel" or "orthogonal" includes not only a case of being completely parallel or orthogonal but also a case of being off parallel or orthogonal within a margin of error. The term "substantially" means being the same within an approximate range.

Figure 2:
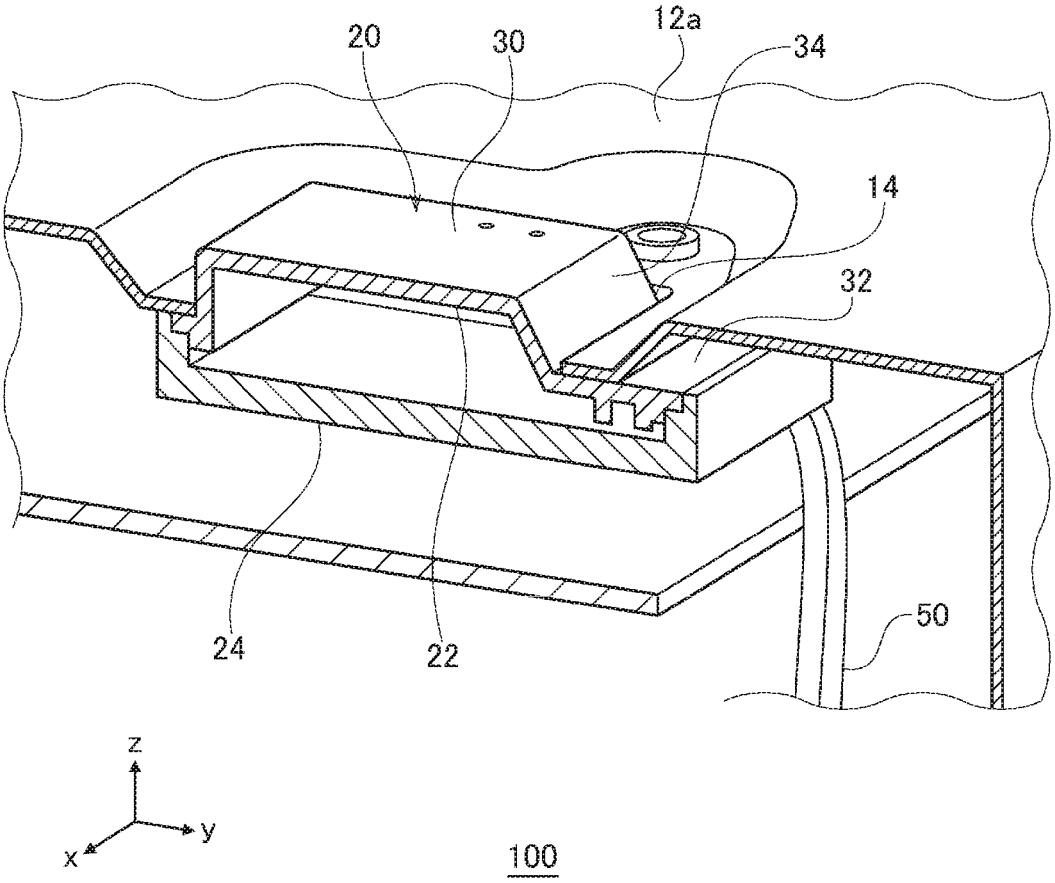
FIG. 2 is a fragmentary sectional view illustrating a structure of the electronic device illustrated in FIG. 1.
Figure 3A:
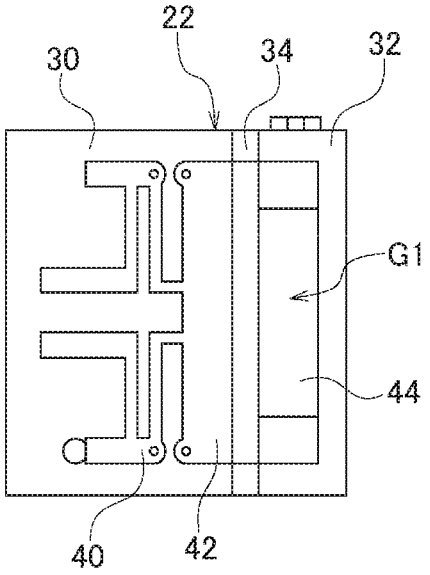
FIGS. 3A and 3B illustrate a structure of an antenna module illustrated in FIG. 1.
Figure 3B:
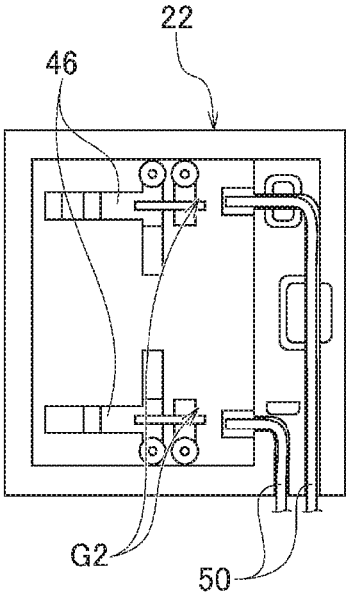
Figure 3B:
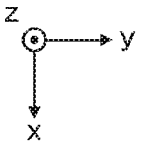
Figure 3B:
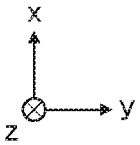

FIG. 1 is a perspective view illustrating a structure of an electronic device 100. FIG. 2 is a fragmentary sectional view illustrating a structure of the electronic device 300. FIG. 2 is also a fragmentary perspective view cut along the AA' line indicated in FIG. 1. FIGS. 3A and 3B illustrate a structure of an antenna module 20. FIG. 3A is a top view of the antenna module 20, and FIG. 3B is a bottom view of the antenna module 20. As illustrated in FIG. 1, an orthogonal coordinate system composed of an x-axis, a y-axis, and a z-axis is defined. The x-axis and the y-axis are orthogonal to each other. The x-axis is perpendicular to the x-axis and the y-axis and extends in a heightwise direction of the electronic device 100. The positive directions along the x-axis, the y-axis, and the z-axis are defined as the directions of the arrowheads indicated in FIG. 1, and the negative directions are defined as the directions opposite to those of the arrowheads. In some cases, the positive direction along the z-axis is referred to as "frontward" or "front side," the negative direction along the x-axis is referred to as "backward" or "back side," the positive direction along the y-axis is referred to as "rightward" or "right side," the negative direction along the y-axis is referred to as "leftward" or "left side," the positive direction along the z-axis is referred to as "upward" or "upper side," and the negative direction along the z-axis is referred to as "downward" or "lower side." In other words, the x-axis extends in the front-back direction, the y-axis extends in the right-left direction, and the z-axis extends in the up-down direction.

A metal housing 10 has a hollow box shape. The metal housing 10 is a hexahedron and is defined by a first surface 12*a*, a second surface 12*b*, a third surface 12*c*, and so on that are each rectangular. Although not depicted in FIG. 1, the metal housing 10 includes a fourth surface 12*d* to a sixth surface 12*f*, and the first surface 12*a* to the sixth surface 12*f* are collectively referred to as a surface 12. The first surface 12*a* corresponds to a top surface and is disposed in the upper side of the metal housing 10. An opening 14 penetrates through the first surface 12*a* in the up-down direction. The size of the opening 14 will be described later.

A base 22 in the antenna module 20 has a step shape, and an upper step surface 30 and a lower step surface 32 are arrayed in a non-overlapping manner in the right-left direction. Specifically, the upper step surface 30 is disposed on the left side, and the lower step surface 32 is disposed on the right side. A step surface 34 that slopes down to the right is so disposed between the upper step surface 30 and the lower step surface 32 as to connect the two. The upper step surface 30, the lower step surface 32, and the step surface 34 are formed into a piece with resin or the like. An antenna pattern 40 is provided in a left side portion of the upper step surface 30. The antenna pattern 40 is formed through any one of vapor deposition, plating, and sheet metal working. A ground pattern 42 is provided continuously from the lower step surface 32 to a right side portion of the upper step surface 30 across the step surface 34. The ground pattern 42 is also formed through any one of vapor deposition, plating, and sheet metal working. A conductive cushion 44 is affixed on the ground pattern 42 on the lower step surface 32.

The upper step surface 30 and the step surface 34 of the antenna module 20 penetrate through the opening 14 from the lower side of the first surface 12*a* and are exposed to the upper side of the opening 14. The lower step surface 32 of the antenna module 20 opposes the back side of the first surface 12*a* without penetrating through the opening 14. Thus, the opening 14 is so sized as to allow the upper step surface 30 and the step surface 34 to penetrate therethrough arid as to disallow the lower step surface 32 to penetrate therethrough. Attaching such an antenna module 20 to the metal housing 10 allows the antenna pattern 40 on the upper step surface 3G and the ground pattern 42 on the upper step surface 30 and on the step surface 34 to be exposed through the opening 14. The front side of the first surface 12*a* and the exposed antenna pattern 40 and ground pattern 42 are at substantially the same height, which provides a structure in which the first surface 12*a*, the antenna pattern 40, and the ground pattern 42 are substantially flush with one another. The ground pattern 42 on the lower step surface 32 opposes the back side of the first surface 12*a*. A protective portion 24 has a box shape with an open top. The protective portion 24 is fitted and fixed under the base 22. The protective portion 24 protects the lower side of the base 22. The structure of the lower side of the base 22 will be described later.

Figure 4:
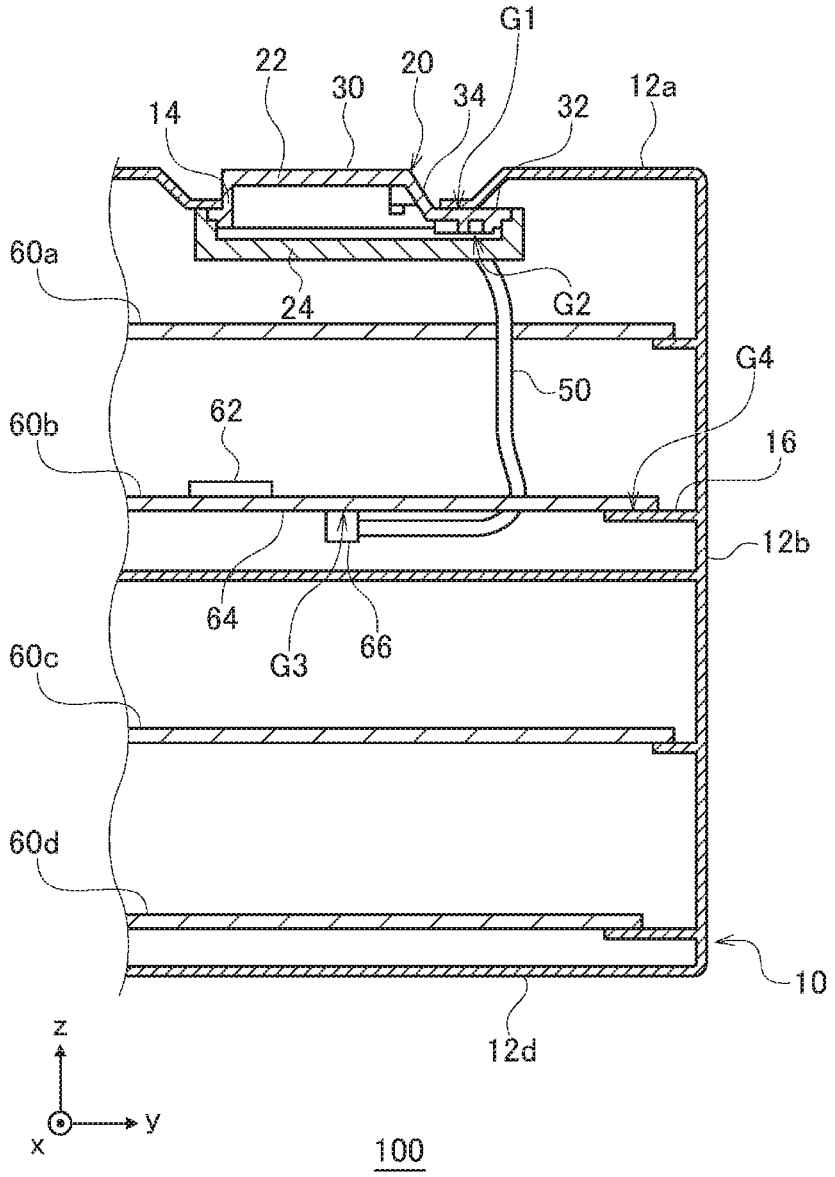
FIG. 4 is a fragmentary sectional view illustrating a structure of the electronic device illustrated in FIG. 1.

FIG. 4 is a fragmentary sectional view illustrating a structure of the electronic device 100. FIG. 4 corresponds to a fragmentary sectional view taken along the A-A' line indicated in FIG. 1. In the electronic device 100, the first surface 12*a*, the second surface 12*b*, and the opening 14 of the metal housing 10; the antenna module 20; and the protective portion 24 have the above-described structure and are disposed in a manner described above. The fourth surface 12*d* serves as a bottom plate. As described above, the interior of the metal housing 30 has a hollow structure. A first substrate 60*a*, a second substrate 60*b*, a third substrate 60*c*, and a fourth substrate 60*d* that each extend in the x-y plane are disposed in this order from the top inside the metal housing 10. The first substrate 60*a* to the fourth substrate 60*d* are collectively referred to as a substrate 60, and a plurality of substrates 60 are disposed in the up-down direction. The number of the substrates 60 to be housed in the metal housing 10 is not limited to four. Among the plurality of substrates 60, attention will be paid to the second substrate 60*b*. A communication circuit 62 is provided on an upper side surface of the second substrate 60*b*, and a ground unit 64 is so provided on a lower side surface of the second substrate 60*b* as to extend over the lower side surface. Well-known techniques may be used in the communication circuit 62 and the ground unit 64, and thus descriptions thereof will be omitted herein.

Hereinafter, ground connection in the electronic device 100 will be described. As described above, the ground pattern 42 on the lower step surface 32 of the antenna module 20 opposes the back side of the first surface 12*a*. The conductive cushion 44 is affixed on the ground pattern 42. Thus, the ground pattern 42 arid the back side of the first surface 12*a* make contact with each other with the conductive cushion 44 interposed therebetween. This configuration provides electrical connection between the ground pattern 42 and the metal housing 10 at a first GND contact G1. The ground pattern 42 and the back side of the first surface 12*a* may be connected to each other with a screw or the like.

As illustrated in FIG. 3B, a back-side pattern 46 is provided on the lower side of the base 22. The back-side pattern 46 is formed similarly to the ground pattern 42. A through-hole (not illustrated) is so provided in the lower step surface 32 of the base 22 as to penetrate through the upper side surface and the lower side surface of the lower step surface 32. The ground pattern 42 and the back-side pattern 46 are connected to each other via the through-hole. Thus, the back-side pattern 46 also corresponds to the ground. The back-side pattern 46 is connected to one end of a coaxial cable SO at a second GND contact G2. Two coaxial cables SO are illustrated as an example.

As illustrated in FIG. 4, another end of the coaxial cable 50 is connected to a contact unit 66 provided on the lower side surface of the second substrate 60*b*. In particular, the contact unit 66 is provided on the ground unit 64, and thus the other end of the coaxial cable 50 is connected to the ground unit 64 at a third GND contact G3. Consequently, the ground pattern 42 is electrically connected to the ground unit 64 via the coaxial cable 50. The second substrate 60*b* is fixed to the metal housing 10 with a screw (not illustrated) or the like. Thus, the ground unit 64 on the second substrate 60*b* is electrically connected to the metal housing 10 at a fourth GND contact G4.

In this manner, in the electronic device 100, the antenna pattern 40 is exposed to the outside of the metal housing 10. The ground pattern 42 and the metal housing 10 are electrically connected to each other at the first GND contact G1. The ground pattern 42 and the ground unit 64 are electrically connected to each other via the second GND contact G2 and the third GND contact G3. The ground unit 64 and the metal housing 10 are electrically connected to each other at the fourth GND contact G4. Thus, the ground of the metal housing 10, the ground of the antenna module 20, and the ground of the second substrate 60*b* result in a common potential.

According to an embodiment of the present disclosure, the antenna pattern is exposed from the metal housing, and thus the influence of the metal housing can be reduced. The ground pattern and the back aide of the first, surface are connected to each other, and this allows for electrical connection between the antenna module and the metal housing. The ground pattern and the ground unit are connected to each other via the coaxial cable, and this allows for electrical connection between the antenna module and the second substrate. The ground unit and the metal housing are connected to each other, and this allows for electrical connection between the second substrate and the metal housing. The antenna module, the metal housing, and the substrate are electrically connected to one another, and thus the influence of the metal housing can be reduced. Since the antenna module, the metal housing, and the substrate are electrically connected to one another, the antenna gain can be improved. Since the antenna gain improves, the transmission distance can be extended. In addition, since the antenna gain improves, the flexibility in the installation position within a vehicle increases. The ground pattern is provided on a portion of the upper seep surface as well, and thus the influence of the metal housing can be further reduced.

An overview of an aspect of the present disclosure is as follows. An electronic device according to an aspect of the present disclosure includes a metal housing including one surface with an opening provided therein; a substrate disposed inside the metal housing, the substrate having a communication circuit and a ground unit provided thereon; and an antenna module including a base having an upper step surface and a lower step surface arrayed in a non-overlapping manner, an antenna pattern provided on the upper step surface, and a ground pattern provided on the lower step surface. In the antenna module, the antenna pattern on the upper step surface is exposed through the opening in the one surface of the metal housing, and the ground pattern on the lower step surface opposes a back side of the one surface of the metal housing. The ground pattern on the lower step surface is electrically connected to the back side of the one surface of the metal housing and electrically connected to the ground unit on the substrate via a cable. The ground unit on the substrate is electrically connected to the metal housing.

According to this aspect, the antenna pattern is exposed, and the antenna module, the metal housing, and the substrate are electrically connected to one another. Thus, the influence of the metal housing can be reduced.

The ground pattern may be provided continuously from the lower step surface to a portion of the upper step surface. In this case, since the ground pattern is provided on a portion of the upper step surface as well, the influence of the metal housing can be further reduced.

Thus far, the present disclosure has been described with an embodiment. This embodiment is illustrative in nature, and it should be appreciated by a person skilled in the art that various modifications can be made to the combinations of the components and the processing processes and that such modifications also fail within the scope of the present disclosure.

In the present embodiment, the ground pattern 42 is so shaped as to extend to a portion of the upper step surface 30. This, however, is not a limiting example, and the ground pattern 42 may, for example, be so shaped as to be disposed only on the lower step surface 32 or so shaped as to extend from the lower step surface 32 to the step surface 34. According to the present modification, the structural flexibility can be improved.

While various embodiments have been described herein above, it is to be appreciated that various changes in form and detail may be made without departing from the spirit and scope of the invention(s) presently or hereafter claimed.

What is claimed is:

1. An electronic device, comprising:

a metal housing including one surface with an opening provided therein;

a substrate disposed inside the metal housing, the substrate having a communication circuit and a ground unit provided thereon; and an antenna module including a base having an upper step surface and & lower step surface arrayed m a non-overlapping manner, an antenna pattern provided on the upper step surface, and a ground pattern provided on the lower, step surface, in the antenna module, the antenna pattern on the upper step surface being exposed through the opening in the one surface of the metal housing, the ground pattern on the lower step surface opposing a back side of the one surface of the metal housing, the ground pattern on the lower step surface being electrically connected to the back side of the one surface of the metal housing and electrically connected to the ground unit on the substrate via a cable, the ground unit on the substrate being electrically connected to the metal housing.

2. The electronic device according to claim 1, wherein the ground pattern is provided continuously from the lower step surface to a portion of the upper step surface.

3. The electronic device according to claim 1, wherein the antenna pattern is termed through any one of vapor deposition, plating, and sheet metal working.

4. The electronic device according to claim 1, wherein the ground pattern is formed through any one of vapor deposition, plating, and sheet metal working.

5. The electronic device according to claim 1, further comprising:

a conductive cushion affixed on the ground pattern on the lower step surface of the antenna module.

6. The electronic device according to claim 1, wherein the communication circuit on the substrate is provided on a surface closer to the antenna module, and the ground unit on the substrate is provided on a surface opposite to the surface where the communication circuit is provided.

* * * * *